US007124700B1

(12) United States Patent
Impey

(10) Patent No.: US 7,124,700 B1
(45) Date of Patent: Oct. 24, 2006

(54) DOCK BRACKET

(76) Inventor: Brian C. Impey, 28817 Blacksmith Ct., Lakemoor, IL (US) 60051

( * ) Notice: Subject to any disclaimer, the term of this patent is extended or adjusted under 35 U.S.C. 154(b) by 233 days.

(21) Appl. No.: 10/884,912

(22) Filed: Jul. 6, 2004

(51) Int. Cl.
*B63B 35/44* (2006.01)

(52) U.S. Cl. ..... 114/263

(58) Field of Classification Search ..... 114/263; 248/225.11, 223.21, 223.41, 222.52, 222.51; 297/376
See application file for complete search history.

(56) References Cited

U.S. PATENT DOCUMENTS 3,025,122 A * 3/1962 Millman ..... 312/245
4,190,221 A * 2/1980 Updike ..... 248/551
4,441,347 A * 4/1984 Taylor ..... 70/370
4,541,598 A * 9/1985 Villanueva et al. .... 248/222.12
6,244,552 B1 * 6/2001 Adams et al. ..... 248/274.1
6,290,075 B1 * 9/2001 Cheimets et al. ..... 211/90.03

* cited by examiner

*Primary Examiner*—Stephen Avila
(74) *Attorney, Agent, or Firm*—Mathew R. P. Perro

(57) ABSTRACT

A dock bracket assembly has a rod supporting bracket and a rod receiving bracket with a N-shaped slot for receiving a section bracket rod, due to the slot. The bracket rod is used with the slot either side of adjoining sections of a dock being constructed.

15 Claims, 7 Drawing Sheets

DOCK BRACKET

This invention relates generally to a dock bracket and more particularly, to a dock bracket permitting assembly of dock without going into the water.

BACKGROUND OF THE INVENTION

Every boat owner, with a property having water frontage desires, to have a dock. With the dock, the boat owner has control of the time and place for putting the boat in the water. With such control, the boat owner can greatly increase the enjoyment that comes with owning a boat.

Construction of a dock is a major project. Much work in the water is required. The special tools and equipment required to support this work in the water add greatly to the cost of producing a dock. Any device, which reduces the cost or simplifies the construction of a dock, can provide many great advantages.

Likewise, there is an advantage for the owner of a marina which services a number of boats to have at least one dock. As the number of docks increases, cost savings and efficiency of construction become more important.

In order to reduce the cost of building a dock, it is very desirable to reduce the required time in the water. No efficient way of accomplishing, this reduction of time in the water now required for dock construction, is available.

Docks are customarily made in sections and held together with clamps. With different clamps, it is required for safety and efficiency to assemble the dock in the water. However, if safety and efficiency can be maintained with great reductions in the assembly process and water, great advantages are obtained.

If the dock is assembled without entering the water, it is required to hold a dock section in a vertical position for a period of time as it is attached to an adjoining section of a dock. Since the dock section is so large, a strong wind can substantially interfere with the dock section in that position. The dock brackets of the prior art cannot withstand such pressure.

SUMMARY OF THE INVENTION

Among the many objectives of this invention is the provision of a dock bracket, which permits assembling of the dock from sections with reduced time in the water.

A further objective of this invention is the provision of a dock bracket, which reduces wind interference during dock installation.

Yet a further objective of this invention is the provision of a dock bracket, which greatly reduces installation problems.

A still further objective of this invention is the provision of a dock bracket, which is easily installed.

Another objective of this invention is the provision of a dock bracket, which is easily stored.

Yet another objective of this invention is the provision of a dock bracket, which is easily supported.

These and other objectives of the invention (which other objectives become clear by consideration of the specification, claims and drawings as a whole) are met by providing a dock bracket assembly with a rod receiving bracket with a N-shaped slot for receiving a rod supporting bracket with a section bracket rod mounted thereon, which is effective due to the slot and bracket rod being used in pairs and supporting a section bracket rod on either side of the dock being constructed.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

For the dock bracket, one end of the bracket allows for attachment to a dock section and one end of the bracket allows for the installation of an additional dock section.

The dock bracket may be attached to a dock section by bolts, or by welding, or by other means that would sufficiently attach such brackets to a dock section.

A desired material of construction for the dock bracket is aluminum, titanium, carbon or low-alloyed steel, stainless steel, or other material that is suitable for machining, forming, stamping, or casting such that the shape of the dock bracket can be produced. The desired material of construction for the dock bracket is also able to withstand the pressures that are exerted on the dock bracket when a strong wind blows against the dock section during installation.

This dock bracket is especially useful for the construction of a dock when a reduction of work to be performed in the water is desired. This dock bracket is also useful when easy storage of such brackets is desired.

Figure 1:
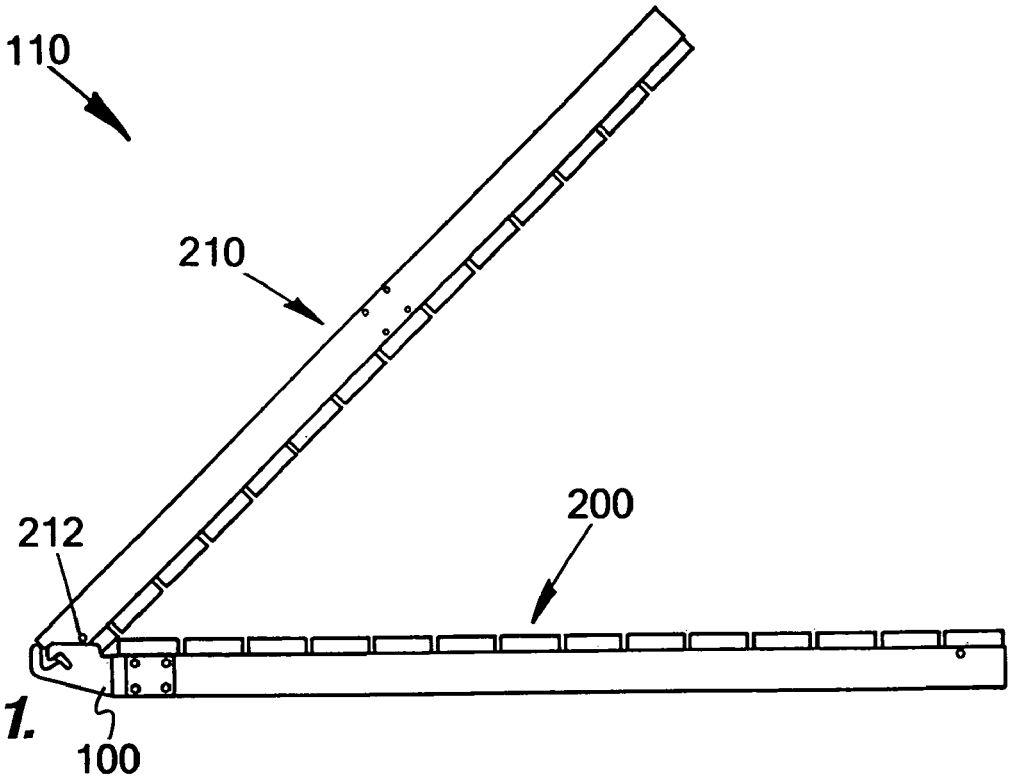
FIG. 1 depicts a side view of dock assembly 110 with section bracket rod 212 attached to dock section 210 placed onto a flat horizontal surface of long dock bracket 100.
Figure 2:
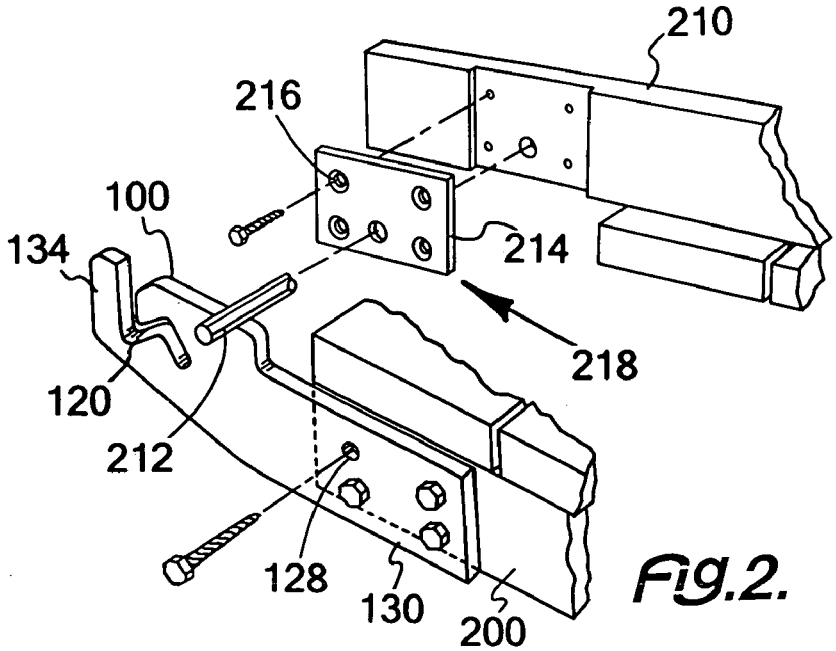
FIG. 2 depicts an exploded view of long dock bracket 100 within a circle in FIG. 1.
Figure 8:
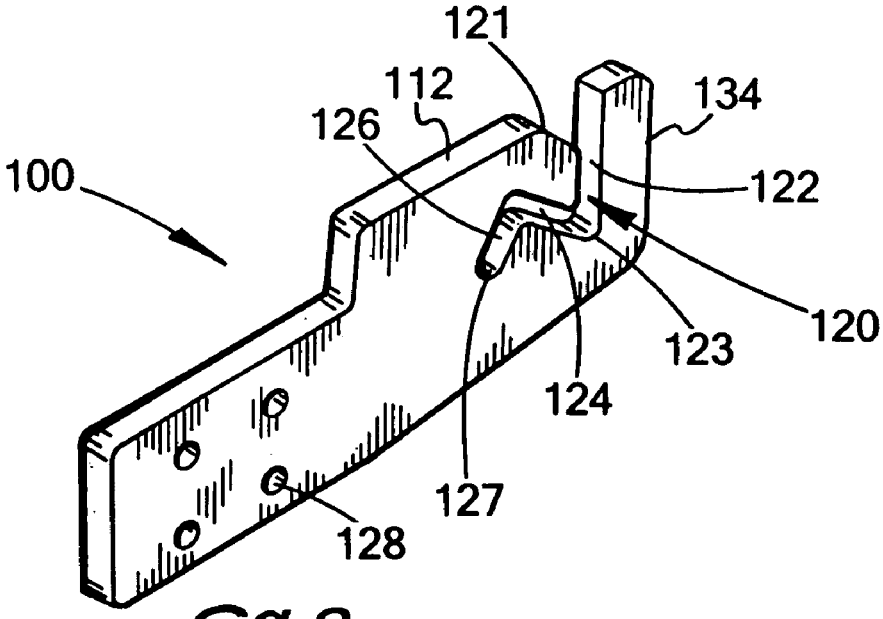
FIG. 8 depicts a side perspective view of universal long dock bracket 100.

Referring now to FIG. 1 and FIG. 2, long dock bracket 100 is attached to dock section 200 by bolting. At least four apertures 128 are preferred in the attachment end 130 of long dock bracket 100 for bolting purposes as depicted in FIG. 2 and FIG. 8, and although less desirable, three apertures 128 may work, and even though less desirable, two apertures 128 may work. The attachment location of long dock bracket 100 on dock section 200 is important such that dock section 210 will fit properly next to dock section 200.

Bolting of long dock bracket 100 to dock section 200 is a preferable method of attachment because bolting of the bracket allows for accurate placement of the long dock bracket 100 onto the dock section. However, long dock bracket 100 may also be attached to dock section 200 by welding, or some other method, if care is taken to attach the long dock bracket 100 at the correct and accurate location on the dock section.

Figure 15:
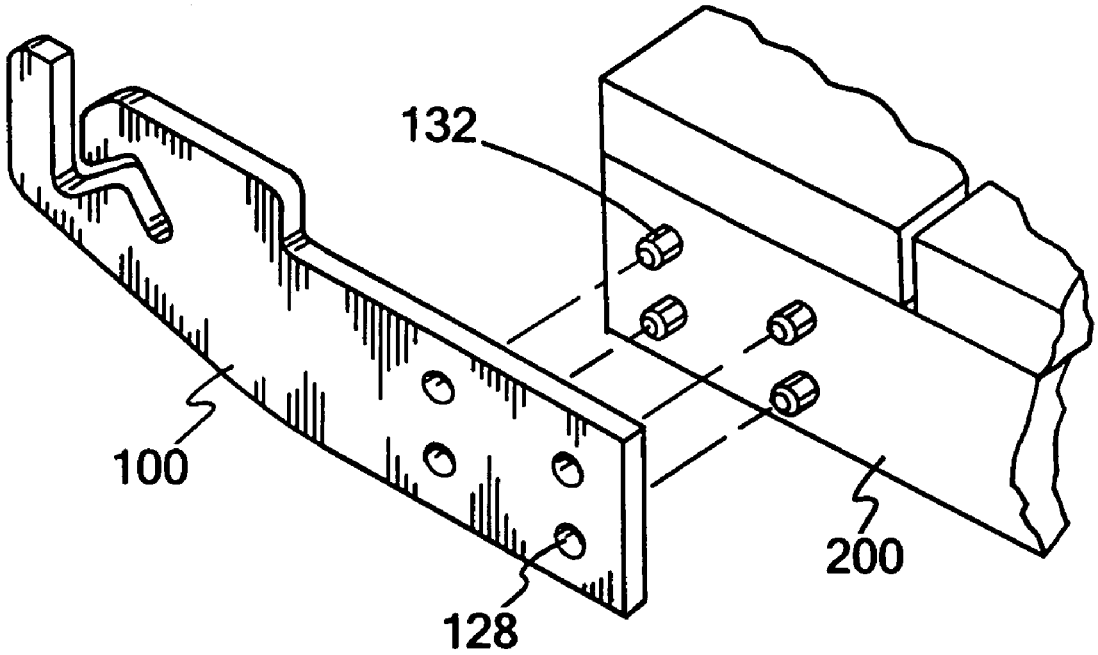
FIG. 15 depicts a perspective view of location pins 132 on dock section 200.

One method of ensuring a correct and accurate location of long dock bracket 100 before welding the bracket onto dock section 200 is to use location pins 132 on the dock section that can couple with apertures 128 in the long dock bracket 100 as depicted in FIG. 15. While coupling of location pins 132 with apertures 128 is a preferred method for correct and accurate location of long bracket 100 on dock section 200, female indentations in long bracket 100 can be used to couple with location pins 132.

Another method of ensuring a correct and accurate location of long dock bracket 100 on dock section 200 or other sections is the accurate placement of the long dock bracket 100 on the dock section by an experienced welder or fitter.

Long dock bracket 100 also has a receiving end 134 with N-shaped slot 120 as depicted in FIG. 8. The N-shaped slot 120 consists of vertical slot 122, extended at an acute angle in a direction toward horizontal surface 112 by angle slot 124, and extended further in a direction away from horizontal surface 112 by receiving slot 126. The N-shaped slot 120 may also appear as an inverted N-shaped slot 120 if long dock bracket 100 is rotated 180 degrees about an axis parallel to vertical slot 122.

The top of first vertical slot 122, at the open end of N-shaped slot 120, has enlarged opening 121. Although an enlarged opening 121 for entry vertical slot 122 is preferred, it is not required. The end of the vertical slot 122 furthest from horizontal surface 112 is vertical slot location 123. The end of long vertical or receiving slot 126 furthest from horizontal surface 112 is nest location 127.

Long dock bracket 100 depicted in FIG. 8 has flat horizontal surface 112 that allows for section bracket rods 212 attached to first dock section 210 to be placed on the horizontal surface as depicted in FIG. 1 and FIG. 2. Placing the section bracket rods 212 attached to the first dock section 210, second dock section 220, and third dock section 230 allows the dock sections to be placed or held in an upright position during assembly of the dock assembly 110 as depicted in FIG. 1, or other dock assemblies.

Figure 3:
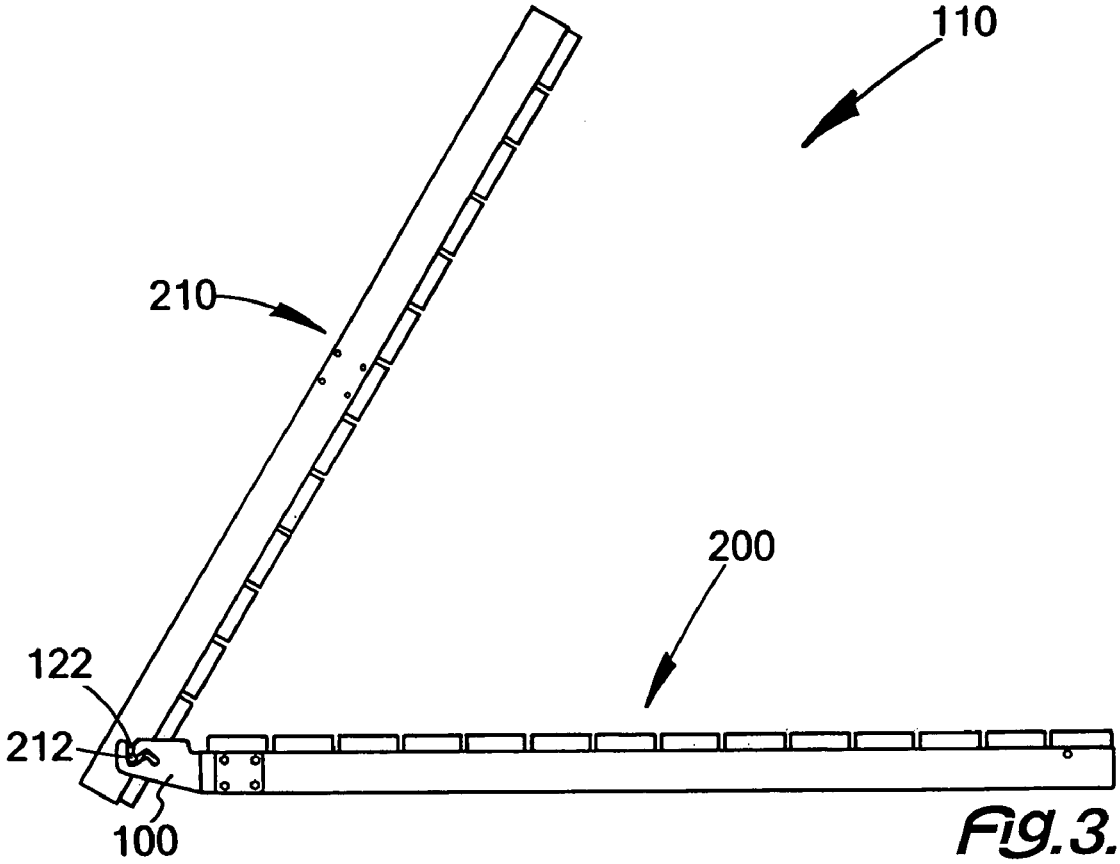
FIG. 3 depicts a side view of dock assembly 110 with section bracket rod 212 attached to dock section 210 dropped into vertical slot 122 of long dock bracket 100.
Figure 4:
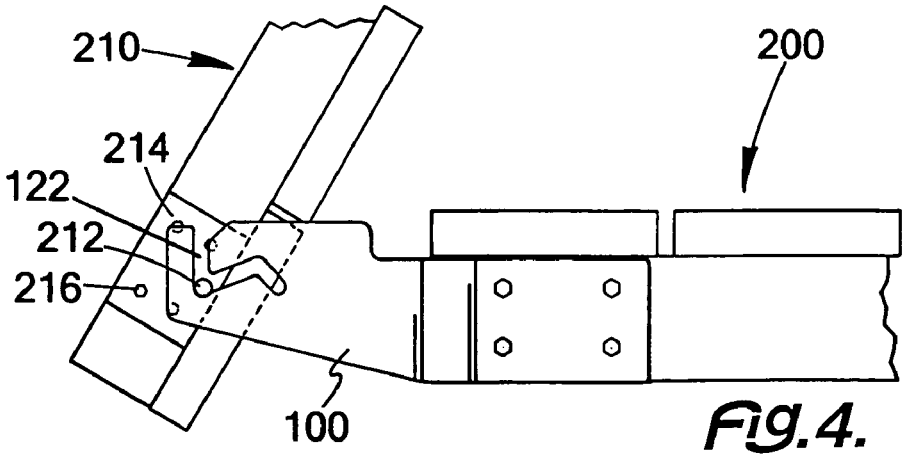
FIG. 4 depicts an exploded view of long dock bracket 100 within a circle in FIG. 3.

Long dock bracket 100 depicted in FIG. 8 also has vertical slot 122 that allows section bracket rods 212 attached to dock section 210 to drop into the vertical slot 122 and fall to vertical slot location 123. Location of section bracket rods 212 at vertical slot location 123 secures dock section 210 during assembly of the dock as depicted in FIG. 3 and FIG. 4.

Each section bracket rod 212 is supported on a rod plate 214. Within rod plate 214 are rod plate apertures 216 suitable for securing rod plate 214 to a dock section 200. Bracket rod 212, rod plate 214, and rod plate apertures 216 form rod supporting bracket 218, which is suitable for mating with inverted N-shaped slot 120. For these purposes inverted N-shaped slot 120 may be on any one of dock bracket 100, left wing dock bracket 102, right wing dock bracket 104, angled left wing dock bracket 106, and angled right wing dock bracket 108.

Although attaching section bracket rod 212 to a dock section 200 using rod plate 214 with rod plate apertures 216 is preferred, rod 212 may be attached to dock section 200 by other suitable means.

Figure 5:
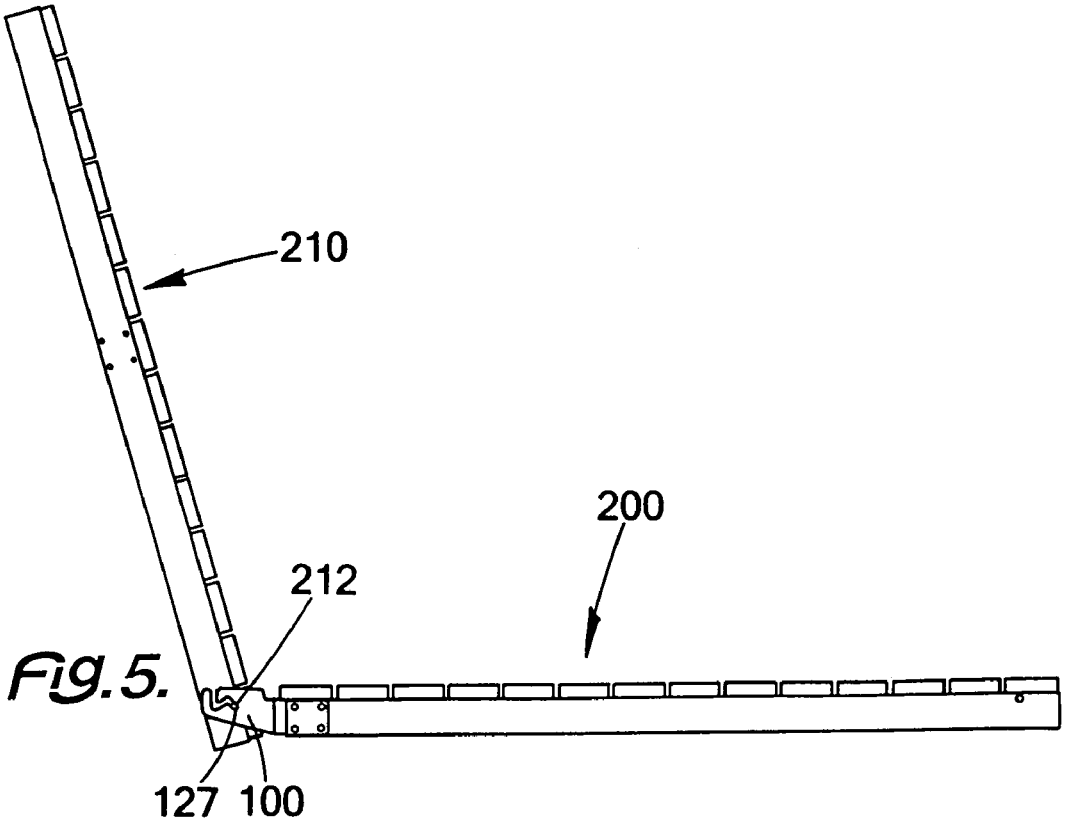
FIG. 5 depicts a side view of a dock assembly 110 with section bracket rod 212 attached to dock section 210 in the nest position 127 of N-shaped slot 120 of long dock bracket 100.
Figure 6:
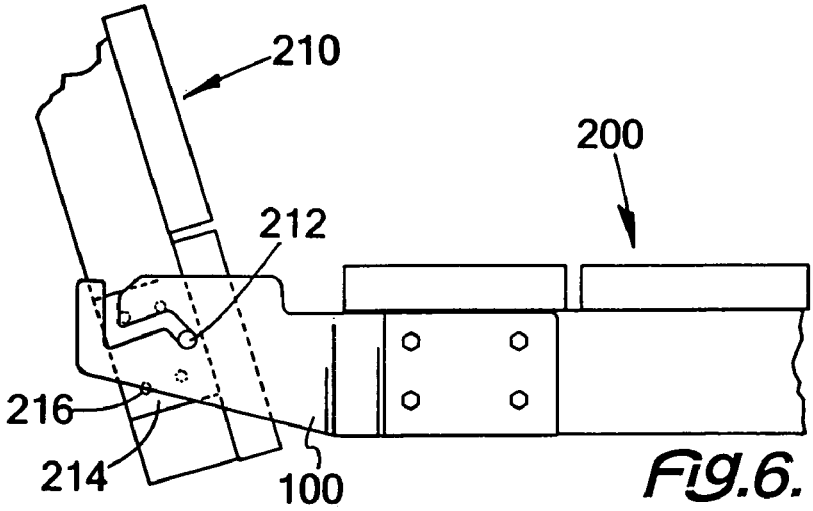
FIG. 6 depicts an exploded view of long dock bracket 100 within a circle in FIG. 5.

Vertical slot 122 in long dock bracket 100 is extended in a direction toward horizontal surface 112 by angle slot 124 and further extended in a direction away from horizontal surface 112 by receiving slot 126. Angle slot 124 and receiving slot 126 allow section bracket rods 212 attached to dock section 210 to be placed at nest location 127 during assembly of the dock as depicted in FIG. 5 and FIG. 6. Placement of section bracket rods 212 at nest location 127 allows for proper location and secure locking of dock section 210 in relation to dock section 200 while dock section 210 is lowered into a final position.

Figure 7:
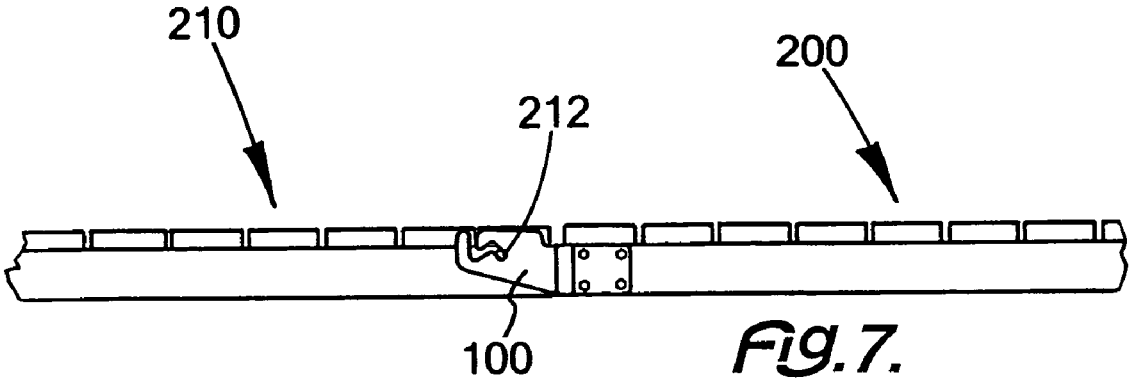
FIG. 7 depicts a side view of dock assembly 110 with dock section 210 being fully lowered into final position.

Long dock bracket 100 attached to dock section 200 and the bracket 100 with long vertical slot 122, angle slot 124, and entry slot 126 also allows dock section 210 to be assembled into final position as depicted in FIG. 7 without entering the water. Long dock bracket 100 can also withstand the pressures that will be exerted by a strong wind blowing on dock section 210 during assembly of the dock as depicted in FIG. 1, FIG. 3, and FIG. 5.

By allowing installation of dock section 210 adjacent to dock section 200 without entering the water and by withstanding the pressures that will be exerted by a strong wind blowing on dock section 210 during assembly, long dock bracket 100 greatly reduces installation problems.

Figure 9:
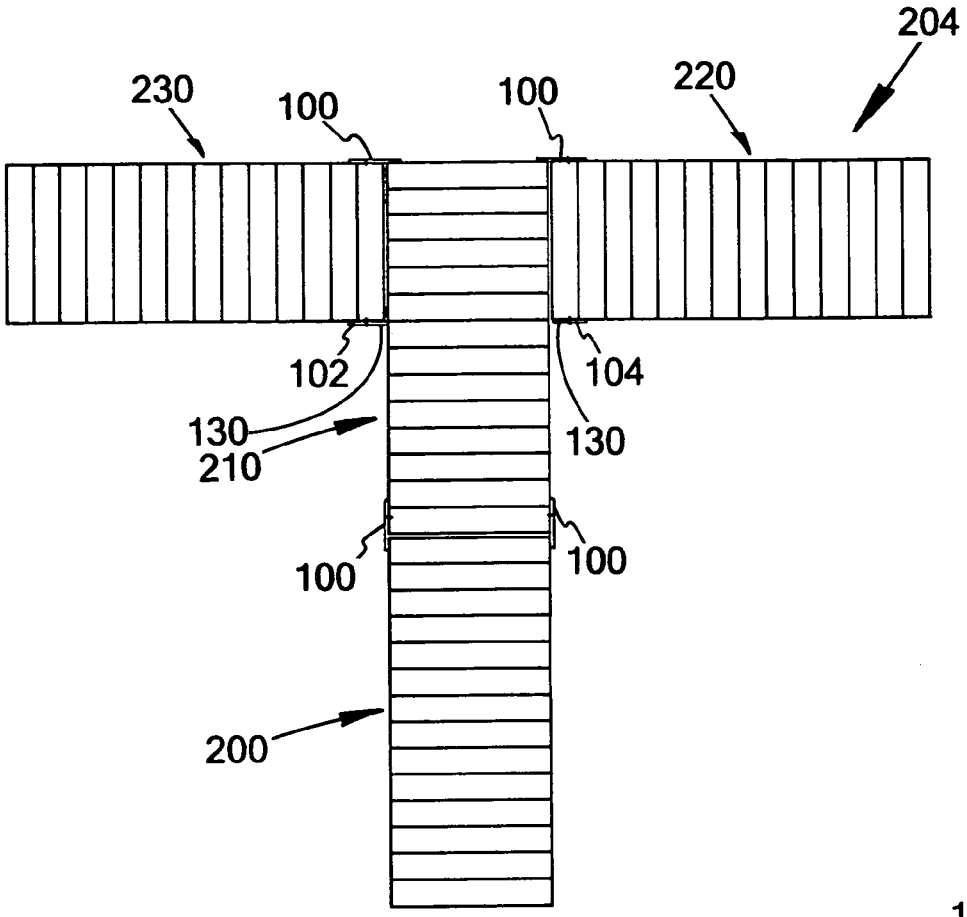
FIG. 9 depicts a top plan view of t-shaped dock assembly 204 with dock section 220 installed on the right of dock section 210 and dock section 230 installed on the left of dock section 210.

Referring now to FIG. 9, dock section 220 is installed on the right side of dock section 210 and dock section 230 is installed on the left side of dock section 210. The installation of dock section 220 and dock section 230 at right angles to dock section 210 restricts available space for the attachment end 130 of a long dock bracket 100 as depicted in FIG. 9.

Figure 10:
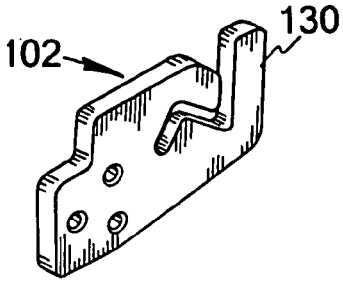
FIG. 10 depicts a side view of left wing dock bracket 102.
Figure 11:
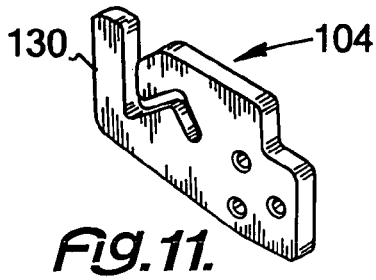
FIG. 11. depicts a perspective view of right wing dock bracket 104.

Left wing dock bracket 102 and right wing dock bracket 104 have a reduced length for the attachment end 130 of the dock bracket 102 and 104 as depicted in FIG. 10 and FIG. 11. These dock brackets 102 and 104 can be attached in locations where a dock section is installed at a right angle to a previously installed dock section 210 as depicted in FIG. 9.

Figure 12:
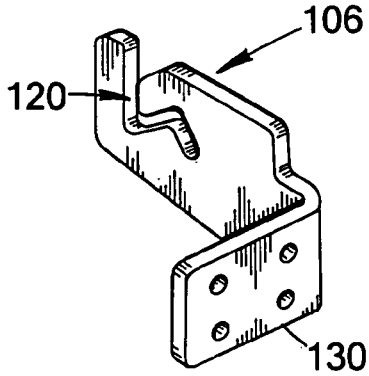
FIG. 12 depicts a perspective view of angled left wing dock bracket 106.
Figure 13:
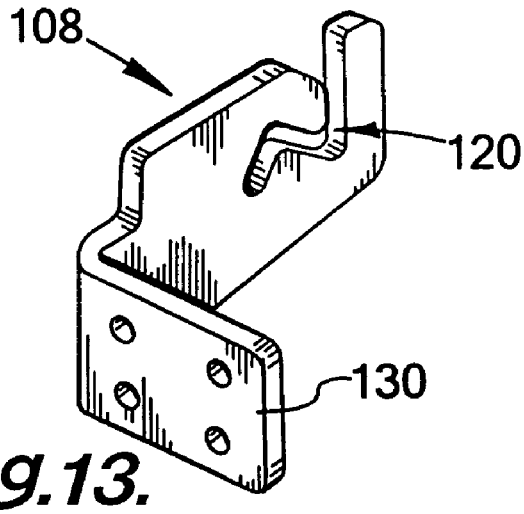
FIG. 13 depicts a perspective view of angled right wing dock bracket 108.

In the alternative to a reduced length for the attachment end 130 of a dock bracket 108, the attachment ends 130 of the dock bracket 106 and the dock bracket 108 are angled in relation to the receiving end of the dock bracket 106 and the dock bracket 108 as depicted in FIG. 12 and FIG. 13. The dock bracket 106 and the dock bracket 108 can also be attached in locations where a dock section 220 or a dock section 230 is installed at a right angle to a previously installed dock section 210 as depicted in FIG. 9.

First dock bracket 102, second dock bracket 104, third dock bracket 106, and dock bracket 108 also have N-shaped slot 120 which allows the installation of dock section 220 and dock section 230 similar to the installation of dock section 210 without entering the water.

Dock bracket 102, dock bracket 104, dock bracket 106, and dock bracket 108 can also withstand the pressures that will be exerted by a strong wind blowing on dock section 220 or dock section 230 during assembly of the dock 102.

By allowing installation of dock section 220 and dock section 230 at right angles to dock section 210 without entering the water, and by withstanding the pressures that will be exerted by a strong wind blowing on dock section 220 or dock section 230 during assembly, dock section 100, dock bracket 102, dock bracket 104, dock bracket 106, and dock bracket 108 greatly reduce installation problems.

Figure 14:
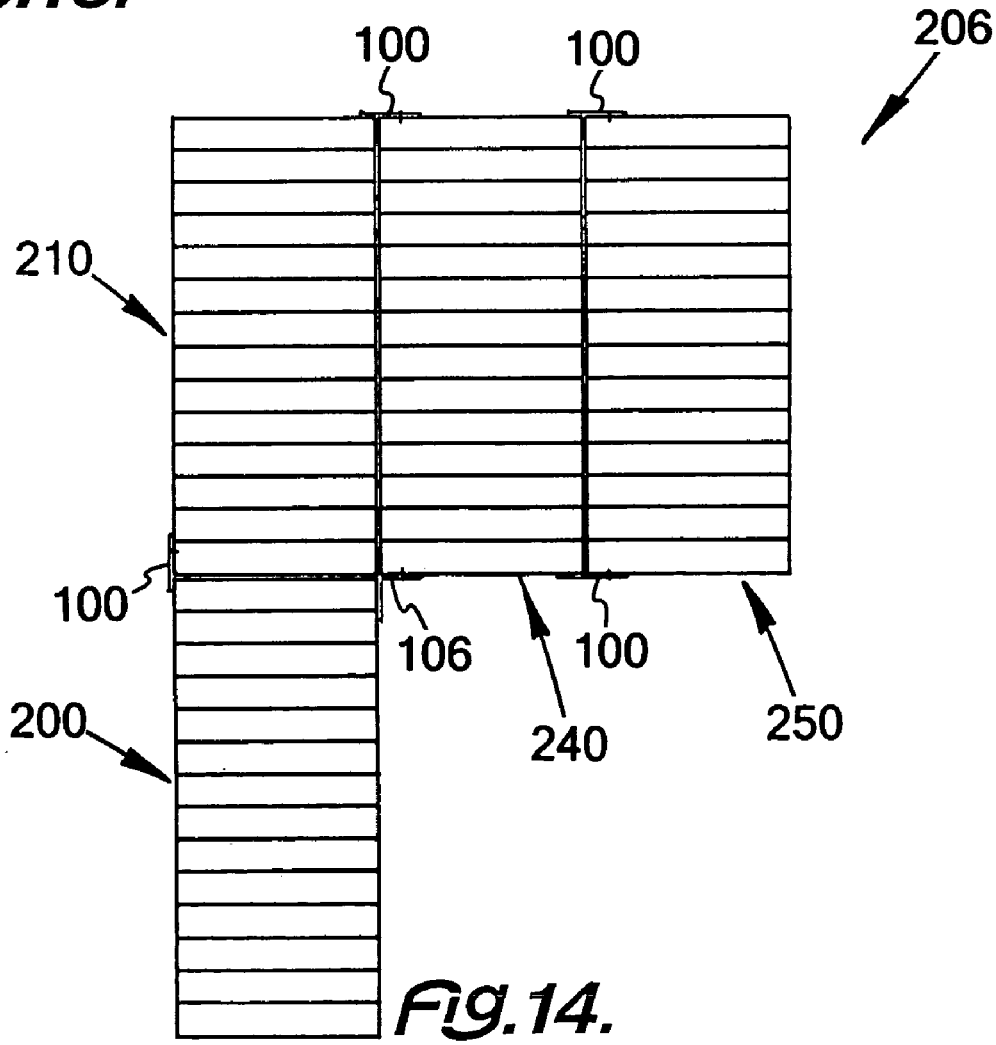
FIG. 14 depicts a top plan view of platform dock assembly 206.

Long dock bracket 100, dock bracket 102, dock bracket 104, dock bracket 106 and dock bracket 108 can also be used in combination with section bracket rods 212 to install dock section 240 and dock section 250 adjacent and parallel to a previously installed dock section 210 in order to form a dock platform assembly 206 as depicted in FIG. 14.

This application; taken as a whole with the abstract, specification, claims, and drawings being combined; provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. A dock bracket comprising:

(a) a flat piece of metal having a first end oppositely disposed from a second end;

(b) the first end allowing attachment to a dock section;

(c) the second end having an N-shaped slot allowing installation of an additional dock section;

(d) the flat piece of metal having a top horizontal surface;

(e) the flat piece of metal having a bottom horizontal surface; and (f) the first end having at least three apertures in order in order to allow the accurate placement and bolting of the bracket to the dock section.

2. The dock bracket of claim 1 further comprising more than three apertures allowing accurate placement and bolting of the bracket to the dock section.

3. The dock bracket in claim 2 further comprising:

(a) the N-shaped slot having a vertical slot which starts at the top horizontal surface, transcends in a direction normal to the top horizontal surface and stops before reaching the bottom horizontal surface;

(b) the N-shaped slot continuing at an acute angle to the vertical slot, in a direction away from the bottom horizontal surface which stops before reaching the top horizontal surface; and (c) continuation of the slot in a direction away from, and normal to, the top horizontal surface and stopping before reaching the bottom horizontal surface.

4. A dock bracket comprising:

(a) a flat piece of metal having a bend at a 90 degree angle normal to the long axis of the piece;

(b) the flat piece of metal having a first bracket end and a second bracket end;

(c) the first bracket end being oppositely disposed from the second bracket end;

(d) the first bracket end having an attachment means for securing the flat piece of metal to at dock section;

(e) the second end having an N-shaped slot allowing installation of an additional dock section;

(f) the flat piece of metal having a top horizontal surface:

(g) the flat piece of metal having a bottom horizontal surface oppositely disposed from the top horizontal surface;

(h) the first end having at least one aperture allowing accurate placement and bolting of the bracket to the dock section;

(i) the N-shaped slot being adapted to support installation of an additional dock section onto the end of an existing dock section without entering the water;

(j) the N-shaped slot having a vertical slot which starts at the ton horizontal surface, transcends in a direction normal to the top horizontal surface and stops before reaching the bottom horizontal surface;

(k) the N-shaped slot continuing at an acute angle to the vertical slot, in a direction away from the bottom horizontal surface which stops before reaching the top horizontal surface; and (l) the N-shaped slot further continuing in a direction away from, and normal to, the top horizontal surface and stopping before reaching the bottom horizontal surface.

5. The dock bracket of claim 4 further comprising the first end having 2 to 4 apertures.

6. In a dock assembly having at least a first dock section and a second dock section, at least one bracket assembly joining the first dock section to the second dock section, the improvement comprising:

(a) the bracket assembly having a rod receiving bracket and a rod supporting bracket;

(b) the rod receiving bracket including a piece of metal;

(c) the piece of metal having a first end oppositely disposed from a second end;

(d) the first end allowing attachment to a dock section;

(e) the second end having an N-shaped slot allowing installation of an additional dock section; and (f) the rod receiving bracket receiving the rod supporting bracket.

7. The dock assembly of claim 6 further comprising the secure installation of at least a third additional dock section parallel to or adjacent to the at least first dock section or at least second dock section of an existing dock section without entering the water.

8. The dock assembly of claim 7 further comprising the secure installation of an additional dock section onto an existing dock section in a direction normal to the existing dock section without entering the water.

9. The dock assembly of claim 6 further comprising:

(a) the rod supporting bracket having a rod plate and a section bracket rod;

(b) the section bracket rod being secured to the rod plate and a section bracket rod;

(c) the N-shaped slot receiving the section bracket rod in order to form the dock assembly;

(d) the first dock section having the rod receiving bracket on each side thereof at a first end;

(e) the first dock section having the rod supporting bracket on each side thereof at a second end;

(f) the second dock section having a pair of the rod receiving bracket and a pair of the rod supporting bracket positioned similarly to a structure of the second dock section; and (g) the pair of the rod receiving bracket on the second dock section receiving the pair of the rod supporting bracket on the first dock section.

10. The dock assembly of claim 9 further comprising:

(a) the rod supporting bracket being a flat piece of metal; and (b) the rod receiving bracket being a flat piece of metal.

11. The dock assembly of claim 10 further comprising the flat piece of metal for the rod receiving bracket having an offset in order to permit the rod supporting bracket to be received therebetween.

12. The dock assembly of claim 11 further comprising the flat piece of metal for the rod receiving bracket having a left angled right angle bend or right angled right angle bend as desired to form the dock assembly from a series of dock sections, the dock sections each being similar to the first dock section or the second dock section.

13. The dock assembly of claim 12 further comprising the flat piece of metal for the rod receiving bracket having an offset in order to permit the rod supporting bracket to be received therebetween.

14. The dock assembly of claim 13 further comprising:

(a) the flat piece of metal having a top horizontal surface;

(b) the flat piece of metal being provided in various lengths in order to form the dock assembly; and (c) the flat piece of metal having a bottom horizontal surface.

15. The dock assembly of claim 14 further comprising:

(a) the dock assembly having a shape selected from the group consisting of a t-shape, a platform shape, and a slot shape;

(b) the flat piece of metal for the rod receiving bracket having a desired bend in order to form a desired dock assembly; and (c) the N-shaped slot the N-shaped slot having a vertical slot which starts at the top horizontal surface, transcends in a direction normal to the top horizontal surface and stops before reaching the bottom horizontal surface;

(d) the N-shaped slot continuing at an acute angle to the vertical slot, in a direction away from the bottom horizontal surface which stops before reaching the top horizontal surface;

(e) a continuation of the slot in a direction away from, and normal to, the top horizontal surface and stopping before reaching the bottom horizontal surface; and (f) the vertical slot providing an enlarged opening in order to receive the rod.

* * * * *